US011607004B2

(12) United States Patent
Jones

(10) Patent No.: US 11,607,004 B2
(45) Date of Patent: Mar. 21, 2023

(54) LIGHT EMITTING SHOE ASSEMBLY

(71) Applicant: Percya Jones, Blue Island, IL (US)

(72) Inventor: Percya Jones, Blue Island, IL (US)

( * ) Notice: Subject to any disclaimer, the term of this patent is extended or adjusted under 35 U.S.C. 154(b) by 0 days.

(21) Appl. No.: 17/400,220

(22) Filed: Aug. 12, 2021

(65) Prior Publication Data

US 2023/0050793 A1 Feb. 16, 2023

(51) Int. Cl.

| | |
|---|---|
| ***A43B 3/36*** | (2022.01) |
| ***F21V 33/00*** | (2006.01) |
| ***F21S 9/02*** | (2006.01) |
| ***F21L 4/02*** | (2006.01) |
| ***G09F 13/06*** | (2006.01) |
| ***F21V 9/40*** | (2018.01) |
| *F21W 121/06* | (2006.01) |

(52) U.S. Cl.

CPC *A43B 3/36* (2022.01); *F21L 4/02* (2013.01); *F21S 9/02* (2013.01); *F21V 9/40* (2018.02); *F21V 33/0004* (2013.01); *G09F 13/06* (2013.01); *F21W 2121/06* (2013.01)

(58) Field of Classification Search

CPC ..... A43B 3/36; F21V 9/40; F21V 33/0004; F21L 4/02; F21S 9/02; G09F 13/06

See application file for complete search history.

(56) References Cited

U.S. PATENT DOCUMENTS

| | | | | |
|---|---|---|---|---|
| 4,158,922 | A * | 6/1979 | Dana, III | A43B 3/102 36/137 |
| 7,204,045 | B2 * | 4/2007 | Lee | A43B 3/36 36/137 |
| 7,762,681 | B2 | 7/2010 | Peckham, Jr. | |
| 8,469,535 | B2 | 6/2013 | Guzman | |
| D863,740 | S | 10/2019 | Takabu | |
| 2004/0255490 | A1 | 12/2004 | Wan | |
| 2011/0146109 | A1 | 6/2011 | Martinez | |
| 2014/0259776 | A1 | 9/2014 | Burga Yllich | |
| 2014/0373395 | A1 | 12/2014 | White | |
| 2020/0077056 | A1 | 3/2020 | Ha | |
| 2021/0298406 | A1 * | 9/2021 | Twombly | A43B 1/0054 |
| 2022/0264989 | A1 * | 8/2022 | Willis | H04R 1/028 |

FOREIGN PATENT DOCUMENTS

| | | | | |
|---|---|---|---|---|
| DE | 202014000504 U1 * | 8/2014 | | A43B 3/001 |
| GB | 2378118 A * | 2/2003 | | A43B 1/0027 |
| KR | 20140067314 A * | 6/2014 | | A43B 3/36 |
| WO | WO2019083146 | 2/2019 | | |

OTHER PUBLICATIONS

Machine translation of KR20140067314 (Year: 2014).*
Machine translation of DE 202014000504 (Year: 2014).*

* cited by examiner

*Primary Examiner* — Leah Simone Macchiarolo

(57) ABSTRACT

A light emitting shoe assembly includes a shoe that is wearable on a user's foot. The shoe has a vamp, a heel, a heel lift, a shank, a heel breast, an outsole and a collar. A light emitter is integrated into the shoe such that the light emitter emits light outwardly from the shoe. A template is integrated into the light emitter and the template is comprised of a light impermeable material to inhibit light from passing through the template. A pattern is punched through the template to produce an image on the support surface. A color switch is movably integrated into the shoe and the color switch is electrically coupled to the light emitter thereby altering a color of light that is emitted by the light emitter.

4 Claims, 7 Drawing Sheets

LIGHT EMITTING SHOE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM.

Not Applicable

STATEMENT REGARDING PRIOR DISCLOSURES BY THE INVENTOR OR JOINT INVENTOR

Not Applicable

BACKGROUND OF THE INVENTION

(1) Field of the Invention.

The disclosure relates to shoe devices and more particularly pertains to a new shoe device for emitting an image onto a support surface upon which a user is walking when the user wears the shoe. The device includes a light emitter that is integrated into the shoe and a template that is positioned over the light emitter. Additionally, the device includes a solar panel that is integrated into the shoe and a rechargeable battery that is integrated into the shoe.

(2) Description of Related Art Including Information Disclosed Under 37 CFR 1.97 and 1.98.

The prior art relates to shoe devices including a covering for a roller skate that includes light emitters. The prior art discloses a variety of articles of footwear that each includes a light emitter for emitting light in a lateral direction with respect to the article of footwear. The prior art discloses a high heeled shoe which includes a light emitting element that is removably attachable to the high heeled shoe.

BRIEF SUMMARY OF THE INVENTION

An embodiment of the disclosure meets the needs presented above by generally comprising a shoe that is wearable on a user's foot. The shoe has a vamp, a heel, a heel lift, a shank, a heel breast, an outsole and a collar. A light emitter is integrated into the shoe such that the light emitter emits light outwardly from the shoe. A template is integrated into the light emitter and the template is comprised of a light impermeable material to inhibit light from passing through the template. A pattern is punched through the template to produce an image on the support surface. A color switch is movably integrated into the shoe and the color switch is electrically coupled to the light emitter thereby altering a color of light that is emitted by the light emitter.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
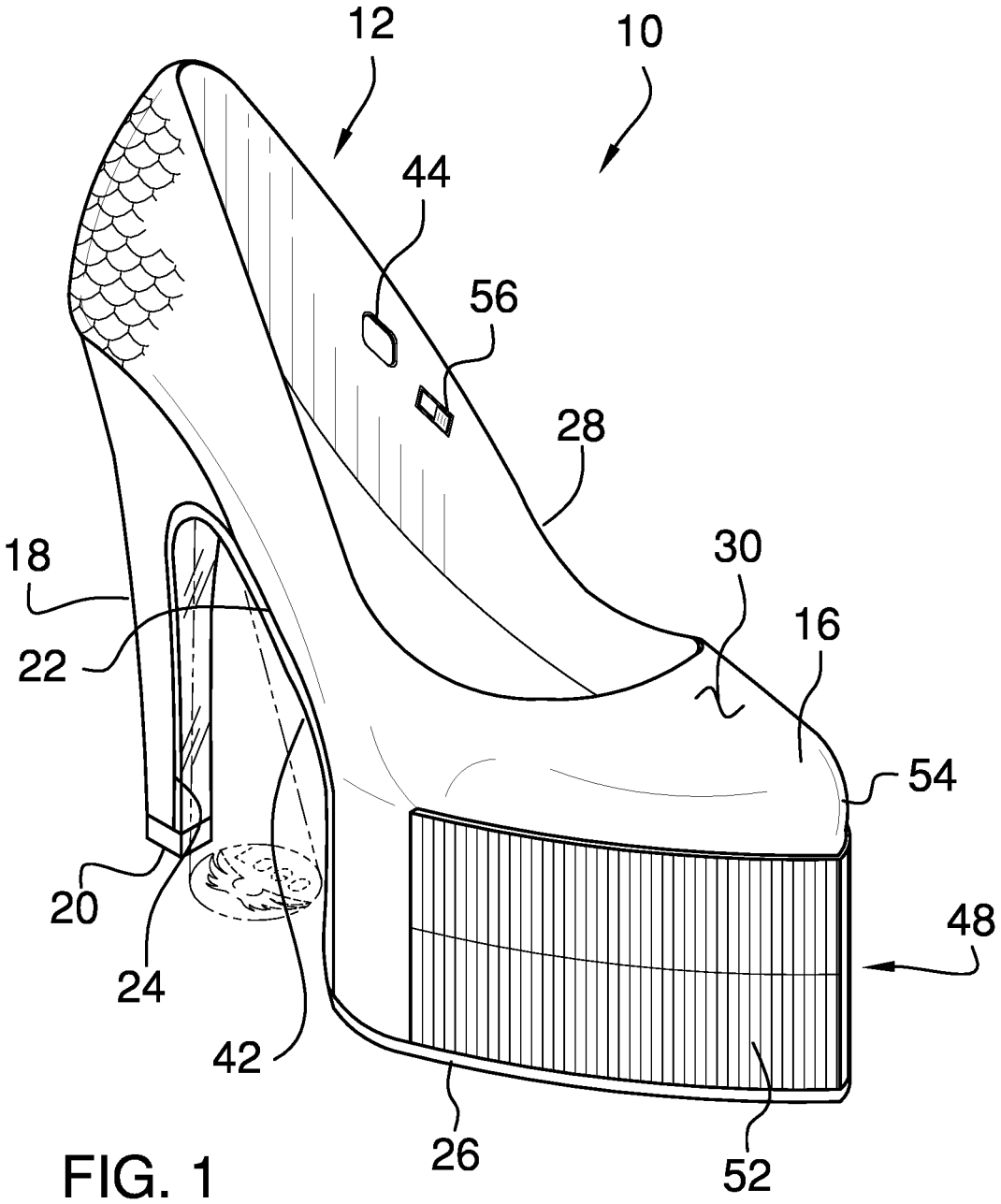
FIG. 1 is a perspective view of a light emitting shoe assembly according to an embodiment of the disclosure.
Figure 2:
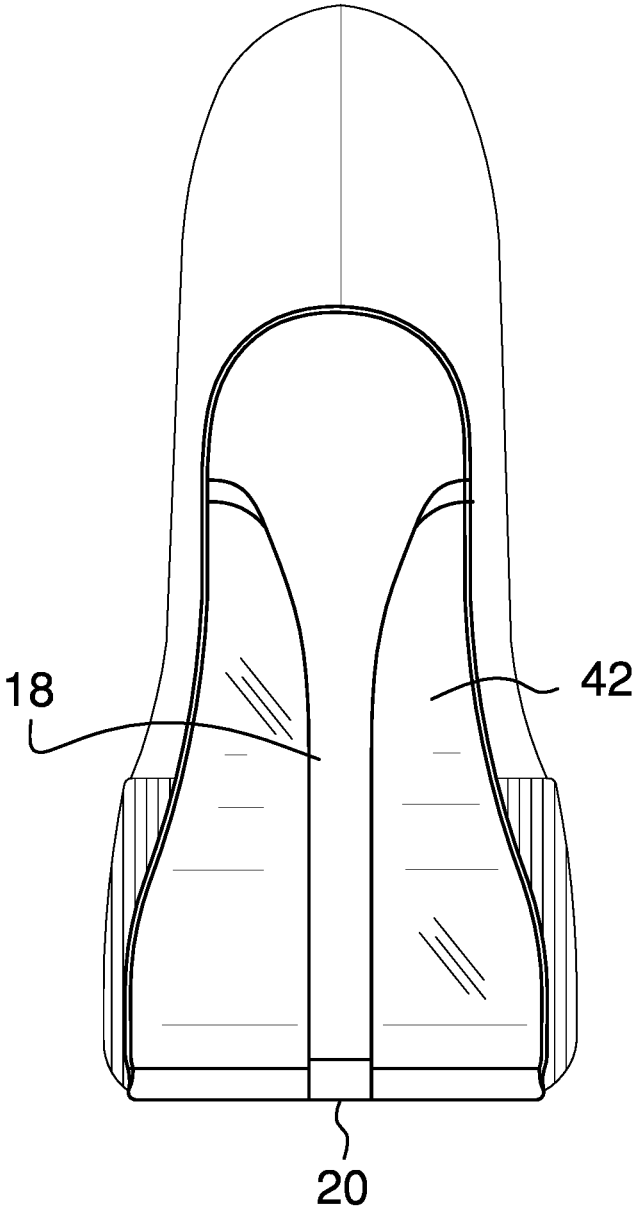
FIG. 2 is a back view of an embodiment of the disclosure.
Figure 3:
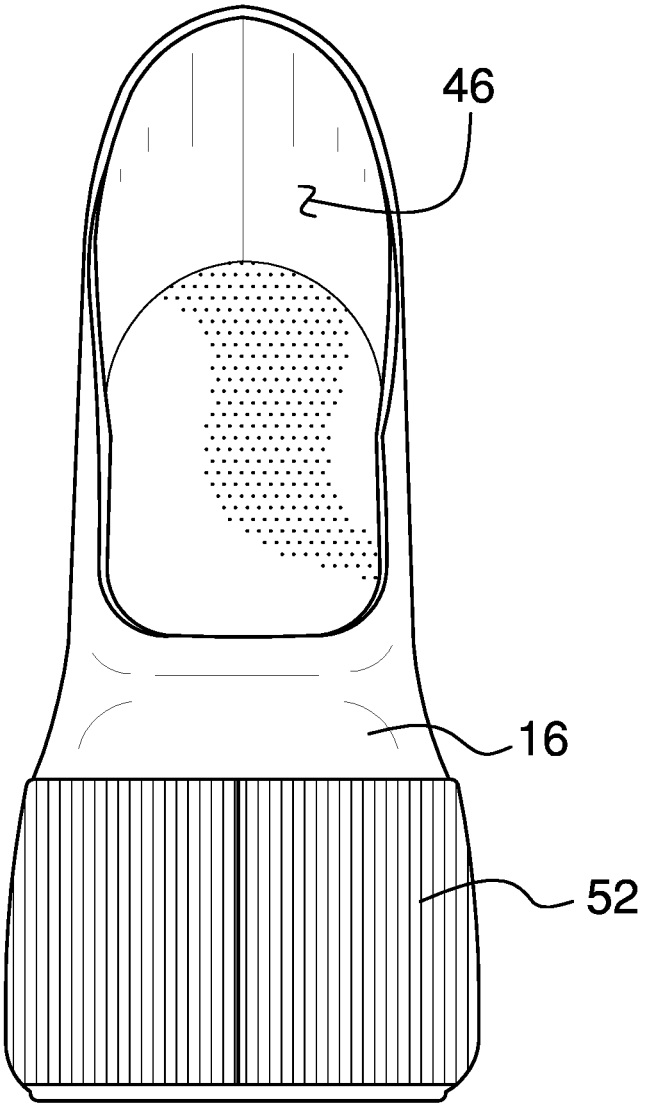
FIG. 3 is a front view of an embodiment of the disclosure.
Figure 4:
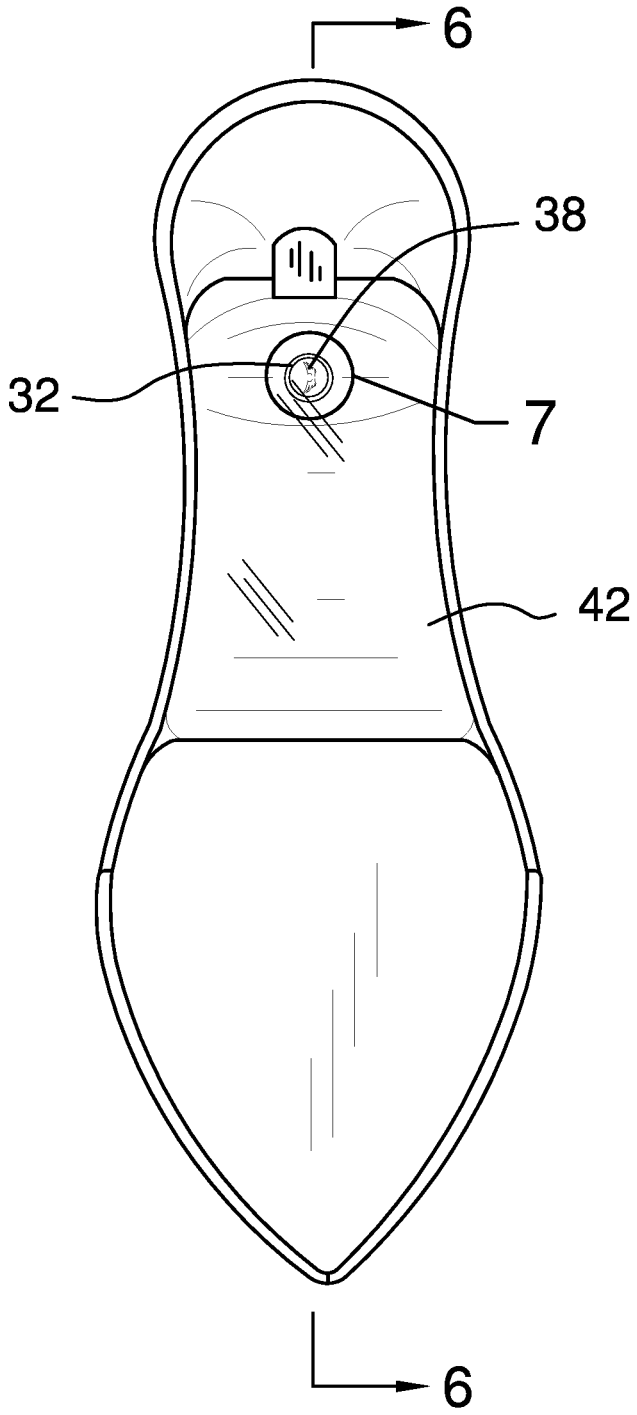
FIG. 4 is a bottom view of an embodiment of the disclosure.
Figure 5:
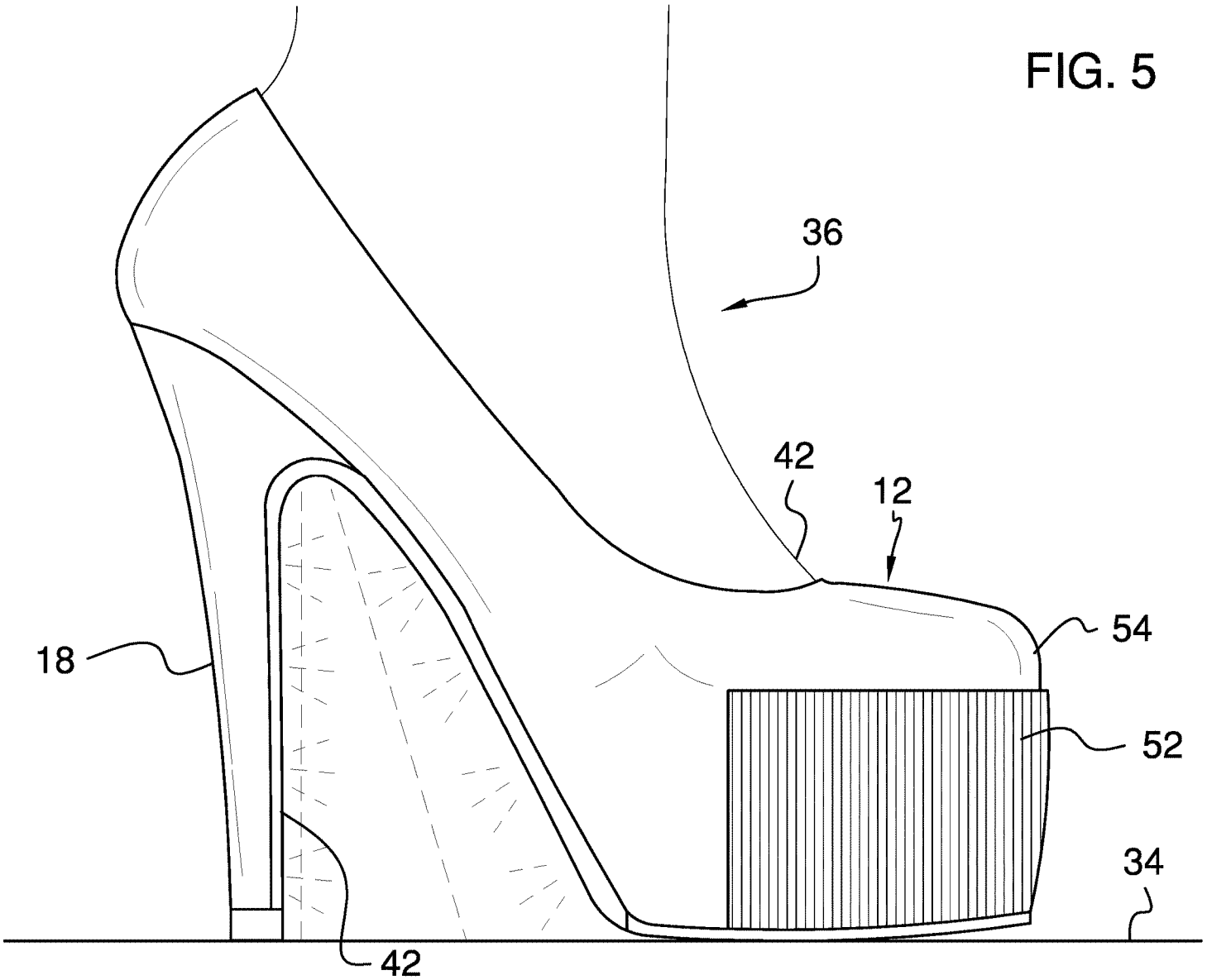
FIG. 5 is a right side view of an embodiment of the disclosure.
Figure 6:
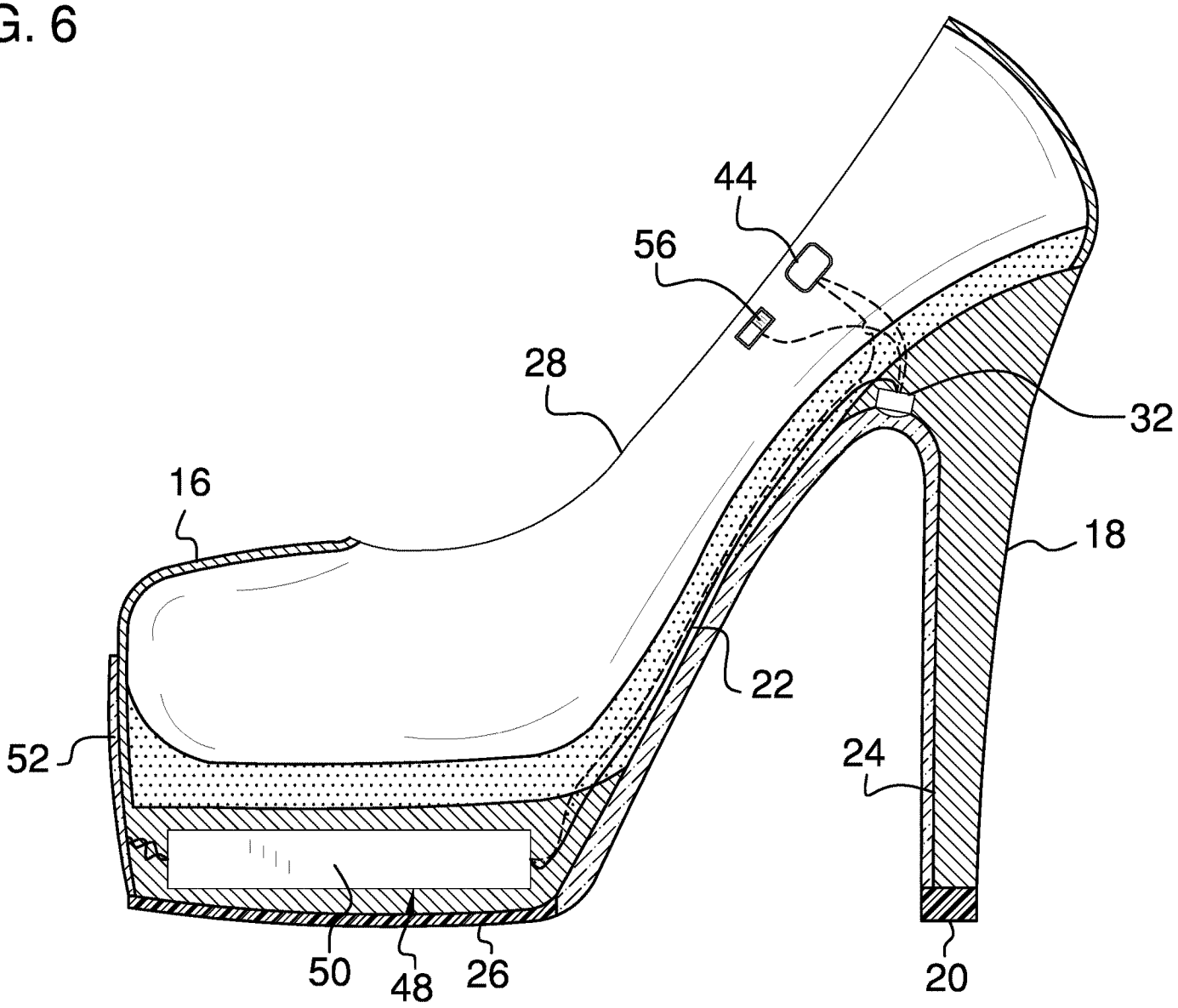
FIG. 6 is a cross sectional view taken along line 6-6 of FIG. 4 of an embodiment of the disclosure.
Figure 7:
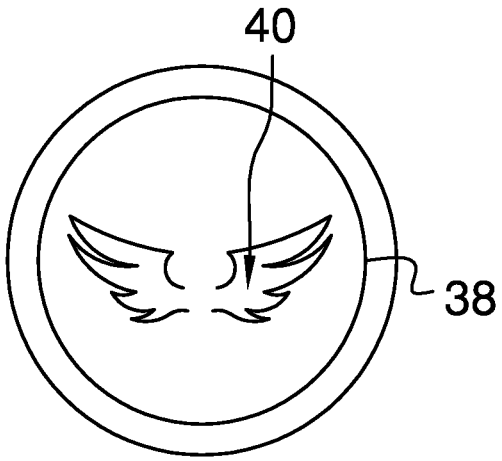
FIG. 7 is a detail view taken from circle 7 of FIG. 4 of an embodiment of the disclosure.

With reference now to the drawings, and in particular to FIGS. 1 through 7 thereof, a new shoe device embodying the principles and concepts of an embodiment of the disclosure and generally designated by the reference numeral 10 will be described.

As best illustrated in FIGS. 1 through 7, the light emitting shoe assembly 10 generally comprises a shoe 12 is wearable on a user's foot 14. The shoe 12 has a vamp 16, a heel 18, a heel lift 20, a shank 22, a heel breast 24, an outsole 26 and a collar 28. Furthermore, the shoe 12 may be a women's high heeled shoe of any conventional design and an outside surface 30 of the shoe 12 may have and ornamental textures resembling a snake skin pattern 40. A light emitter 32 is integrated into the shoe 12 to emit light outwardly from the shoe 12. The light emitter 32 is integrated into the shank 22 such that the light emitter 32 emits light downwardly onto a support surface 34 upon which the user 36 is walking. Additionally, the light emitter 32 is positioned adjacent to an intersection between the heel breast 24 and the shank 22. The light emitter 32 may comprise a light emitting diode or other type of electronic light emitter that is capable of emitting light in a variety of different colors.

A template 38 is integrated into the light emitter 32 and the template 38 is comprised of a light impermeable material to inhibit light from passing through the template 38. Furthermore, the template 38 has a pattern 40 that is punched through the template 38. In this way the pattern 40 allows pass light through the pattern 40 thereby facilitating the light emitter 32 to produce an image on the support surface 34. The pattern 40 may be a winged phoenix, a company logo or any other image or indicia.

A lens 42 is coupled to the shoe 12 and the lens 42 extends along the heel breast 24 and the shank 22 such that the lens 42 covers the light emitter 32. The lens 42 extends from the heel lift 20 to a threshold between the outsole 26 and the shank 22. The lens 42 is comprised of a translucent material to pass light therethrough and the lens 42 extends between the heel lift 20 and a threshold between the outsole 26 and the shank 22. Additionally, the lens 42 may be comprised of a shatter proof material such that the lens 42 is inhibited from being damaged by walking on the shoe 12 or by being damaged from impact. A color switch 44 is movably integrated into the shoe 12 and the color switch 44 is electrically coupled to the light emitter 32 thereby altering a color of light being emitted by the light emitter 32. The color switch 44 is positioned on an inside surface 46 of the shoe 12 and the color switch 44 is positioned adjacent to the collar 28 of the shoe 12.

A power supply 48 is integrated into the shoe 12 and the power supply 48 is electrically coupled to the light emitter 32. The power supply 48 comprises a rechargeable battery 50 that is integrated into the outsole 26 of the shoe 12 and the rechargeable battery 50 is electrically coupled to the light emitter 32. The power supply 48 includes a solar panel 52 that is coupled to an outside surface 30 of the shoe 12 such that the solar panel 52 is exposed to sunlight. The solar panel 52 is electrically coupled to the rechargeable battery 50 for charging the rechargeable battery 50. Additionally, the solar panel 52 is positioned on the vamp 16 and the solar panel 52 extends around a tip 54 of the shoe 12. The power supply 48 includes a power switch 56 that is slidably integrated into the shoe 12. The power switch 56 is electrically coupled to the light emitter 32 for turning the light emitter 32 on and off. Furthermore, the power switch 56 is positioned on the inside surface 46 of the shoe 12 and the power switch 56 is positioned adjacent to the collar 28 of the shoe 12.

In use, the power switch 56 is moved to an on position to turn on the light emitter 32 and the color switch 44 is manipulated to select the color of light that is emitted by the light emitter 32. In this way the light emitter 32 produces an image on the support surface 34 upon which the user 36 is walking when the user 36 wears the shoe 12. Additionally, the solar panel 52 continuously charges the rechargeable battery 50 when the solar panel 52 is exposed to sunlight.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A light emitting shoe assembly for emitting a logo onto a support surface while being worn, said assembly comprising:

a shoe being wearable on a user's foot, said shoe having a vamp, a heel, a heel lift, a shank, a heel breast, an outsole and a collar;

a light emitter being integrated into said shoe wherein said light emitter is configured to emit light outwardly from said shoe, wherein said light emitter is integrated into said shank wherein said light emitter is configured to emit light downwardly onto a support surface upon which the user is walking, said light emitter being positioned adjacent to an intersection between said heel breast and said shank;

a template being integrated into said light emitter, said template being comprised of a light impermeable material wherein said template is configured to inhibit light from passing through said template, said template having a pattern being punched through said template wherein said pattern is configured to pass light through said pattern thereby facilitating said light emitter to produce an image on the support surface;

a color switch being movably integrated into said shoe, said color switch being electrically coupled to said light emitter thereby altering a color of light being emitted by said light emitter; and a lens being coupled to said shoe, said lens extending along said heel breast and said shank such that said lens covers said light emitter, said lens extends from said heel lift to a threshold between said outsole and said shank, said lens being comprised of a translucent material wherein said lens is configured to pass light therethrough, said lens extending between said heel lift and a threshold between said outsole and said shank.

2. The assembly according to claim 1, wherein said color switch is positioned on an inside surface of said shoe, said color switch being positioned adjacent to said collar of said shoe.

3. A light emitting shoe assembly for emitting a logo onto a support surface while being worn, said assembly comprising:

a shoe being wearable on a user's foot, said shoe having a vamp, a heel, a heel lift, a shank, a heel breast, an outsole and a collar;

a light emitter being integrated into said shoe wherein said light emitter is configured to emit light outwardly from said shoe;

a template being integrated into said light emitter, said template being comprised of a light impermeable material wherein said template is configured to inhibit light from passing through said template, said template having a pattern being punched through said template wherein said pattern is configured to pass light through said pattern thereby facilitating said light emitter to produce an image on the support surface;

a color switch being movably integrated into said shoe, said color switch being electrically coupled to said light emitter thereby altering a color of light being emitted by said light emitter; and a power supply being integrated into said shoe, said power supply being electrically coupled to said light emitter, said power supply comprising:

a rechargeable battery being integrated into said outsole of said shoe, said rechargeable battery being electrically coupled to said light emitter;

a solar panel being coupled to an outside surface of said shoe wherein said solar panel is configured to be exposed to sunlight, said solar panel being electrically coupled to said rechargeable battery for charging said rechargeable battery, said solar panel being positioned on said vamp, said solar panel extending around a tip of said shoe; and a power switch being slidably integrated into said shoe, said power switch being electrically coupled to said light emitter for turning said light emitter on and off, said power switch being positioned on said inside surface of said shoe, said power switch being positioned adjacent to said collar of said shoe.

4. A light emitting shoe assembly for emitting a logo onto a support surface while being worn, said assembly comprising:

a shoe being wearable on a user's foot, said shoe having a vamp, a heel, a heel lift, a shank, a heel breast, an outsole and a collar;

a light emitter being integrated into said shoe wherein said light emitter is configured to emit light outwardly from said shoe, said light emitter being integrated into said shank wherein said light emitter is configured to emit light downwardly onto a support surface upon which the user is walking, said light emitter being positioned adjacent to an intersection between said heel breast and said shank;

a template being integrated into said light emitter, said template being comprised of a light impermeable material wherein said template is configured to inhibit light from passing through said template, said template having a pattern being punched through said template wherein said pattern is configured to pass light through said pattern thereby facilitating said light emitter to produce an image on the support surface;

a lens being coupled to said shoe, said lens extending along said heel breast and said shank such that said lens covers said light emitter, said lens extending from said heel lift to a threshold between said outsole and said shank, said lens being comprised of a translucent material wherein said lens is configured to pass light therethrough, said lens extending between said heel lift and a threshold between said outsole and said shank;

a color switch being movably integrated into said shoe, said color switch being electrically coupled to said light emitter thereby altering a color of light being emitted by said light emitter, said color switch being positioned on an inside surface of said shoe, said color switch being positioned adjacent to said collar of said shoe; and a power supply being integrated into said shoe, said power supply being electrically coupled to said light emitter, said power supply comprising:

a rechargeable battery being integrated into said outsole of said shoe, said rechargeable battery being electrically coupled to said light emitter;

a solar panel being coupled to an outside surface of said shoe wherein said solar panel is configured to be exposed to sunlight, said solar panel being electrically coupled to said rechargeable battery for charging said rechargeable battery, said solar panel being positioned on said vamp, said solar panel extending around a tip of said shoe; and a power switch being slidably integrated into said shoe, said power switch being electrically coupled to said light emitter for turning said light emitter on and off, said power switch being positioned on said inside surface of said shoe, said power switch being positioned adjacent to said collar of said shoe.

* * * * *